United States Patent [19]

Hanson

[11] Patent Number: 4,977,752

[45] Date of Patent: Dec. 18, 1990

[54] TRANSPORT REFRIGERATION INCLUDING METHODS AND APPARATUS FOR OPTMIZING SAME

[75] Inventor: Jay L. Hanson, Bloomington, Minn.

[73] Assignee: Thermo King Corporation

[21] Appl. No.: 458,278

[22] Filed: Dec. 28, 1989

[51] Int. Cl.[5] ..... F25B 27/00

[52] U.S. Cl. ..... 62/115; 62/213; 62/236; 165/12

[58] Field of Search ..... 62/236, 229, 213, 115, 62/231; 165/12

[56] References Cited

U.S. PATENT DOCUMENTS

| | | | |
|---|---|---|---|
| 3,973,618 | 8/1976 | Naley et al. | 62/213 X |
| 4,325,224 | 4/1982 | Howland | 62/228 X |
| 4,419,866 | 12/1983 | Howland | 62/228.4 |
| 4,622,827 | 11/1986 | Jabami et al. | 62/213 X |
| 4,712,383 | 12/1987 | Howland et al. | 62/200 |
| 4,720,980 | 1/1988 | Howland | 62/236 X |
| 4,819,441 | 4/1989 | Hanson | 62/160 |
| 4,853,693 | 8/1989 | Williams | 165/12 X |

*Primary Examiner*—William E. Wayner

[57] ABSTRACT

A transport refrigeration system having a refrigerant compressor which is selectively operable with either an electric motor or an internal combustion engine. The transport refrigeration system conditions a load space to a selected set point via heating and cooling modes in response to a selected one of either a return air sensor or a discharge air sensor. System control is automatically optimized in response to manual selections of the prime mover and the operative sensor by providing first, second, third and fourth control algorithms. Selection of the return air sensor automatically selects the first and third control algorithms for electric motor and internal combustion engine, respectively, and selection of the discharge air sensor automatically selects the second and fourth control algorithms for the electric motor and internal combustion engine, respectively.

10 Claims, 8 Drawing Sheets

DIESEL OPERATION-RETURN AIR CONTROL

FALLING TEMPERATURE ↓

| | DIGITAL SIGNAL (MSB) A | B | C | D | E | F | G | H (LSB) | WORD # | ACTIVE RESISTORS RW1 | RW2 | R1 | R2 | R3 | VALVE CURRENT |
|---|---|---|---|---|---|---|---|---|---|---|---|---|---|---|---|
| | 0 | 0 | 0 | 0 | 0 | 0 | 0 | 0 | 1 | | | | | | 0 |
| | 0 | 1 | 1 | 0 | 1 | 1 | 1 | 1 | 111 | | | | | | 0 |
| +3.4 | 0 | 1 | 1 | 1 | 0 | 0 | 0 | 0 | 112 | X | | | | | .572 |
| | 0 | 1 | 1 | 1 | 0 | 0 | 0 | 1 | 113 | | | | | X | .636 |
| | 0 | 1 | 1 | 1 | 0 | 0 | 1 | 0 | 114 | X | | | X | | .665 |
| | 0 | 1 | 1 | 1 | 0 | 0 | 1 | 1 | 115 | X | | | X | X | .719 |
| | 0 | 1 | 1 | 1 | 0 | 1 | 0 | 0 | 116 | X | | X | | | .745 |
| | 0 | 1 | 1 | 1 | 0 | 1 | 0 | 1 | 117 | X | | X | | X | .793 |
| | 0 | 1 | 1 | 1 | 0 | 1 | 1 | 0 | 118 | X | | X | X | | .814 |
| | 0 | 1 | 1 | 1 | 0 | 1 | 1 | 1 | 119 | X | | X | X | X | .856 |
| | 0 | 1 | 1 | 1 | 1 | 0 | 0 | 0 | 120 | X | X | | | | .872 |
| | 0 | 1 | 1 | 1 | 1 | 0 | 0 | 1 | 121 | X | X | | | X | .909 |
| | 0 | 1 | 1 | 1 | 1 | 0 | 1 | 0 | 122 | X | X | | X | | .926 |
| | 0 | 1 | 1 | 1 | 1 | 0 | 1 | 1 | 123 | X | X | | X | X | .959 |
| | 0 | 1 | 1 | 1 | 1 | 1 | 0 | 0 | 124 | X | X | X | | | .975 |
| | 0 | 1 | 1 | 1 | 1 | 1 | 0 | 1 | 125 | X | X | X | | X | 1.005 |
| | 0 | 1 | 1 | 1 | 1 | 1 | 1 | 0 | 126 | X | X | X | X | | 1.018 |
| | 0 | 1 | 1 | 1 | 1 | 1 | 1 | 1 | 127 | X | X | X | X | X | 1.045 |
| SP | 1 | 0 | 0 | 0 | 0 | 0 | 0 | 0 | 128 | X | X | X | X | | 1.018 |
| | 1 | 0 | 0 | 0 | 0 | 0 | 0 | 1 | 129 | X | X | X | X | | 1.018 |
| | 1 | 0 | 0 | 0 | 0 | 0 | 1 | 0 | 130 | X | | X | | | .745 |
| | 1 | 0 | 0 | 0 | 0 | 0 | 1 | 1 | 131 | X | | X | | | .745 |
| | 1 | 0 | 0 | 0 | 0 | 1 | 0 | 0 | 132 | X | | | | | .572 |
| | 1 | 0 | 0 | 0 | 0 | 1 | 0 | 1 | 133 | X | | | | | .572 |
| | 1 | 0 | 0 | 0 | 0 | 1 | 1 | 0 | 134 | X | | | | | .572 |
| | 1 | 0 | 0 | 0 | 0 | 1 | 1 | 1 | 135 | X | | | | | .572 |
| -1.7 | 1 | 0 | 0 | 0 | 1 | 0 | 0 | 0 | 136 | | | | | | 0 |
| | 1 | 1 | 1 | 1 | 1 | 1 | 1 | 1 | 256 | | | | | | |

↑ RISING TEMPERATURE

111

FIG. 7

DIESEL OPERATION - DISCHARGE AIR CONTROL

FALLING TEMPERATURE ↓

| | DIGITAL SIGNAL (MSB) A | B | C | D | E | F | G | H (LSB) | WORD # | ACTIVE RESISTORS RW1 | RW2 | R1 | R2 | R3 | VALVE CURRENT |
|---|---|---|---|---|---|---|---|---|---|---|---|---|---|---|---|
| | 0 | 0 | 0 | 0 | 0 | 0 | 0 | 0 | 1 | | | | | | 0 |
| | 0 | 1 | 1 | 0 | 1 | 1 | 1 | 1 | 111 | | | | | | |
| | 0 | 1 | 1 | 1 | 0 | 0 | 0 | 0 | 112 | | | | | | |
| | 0 | 1 | 1 | 1 | 0 | 0 | 0 | 1 | 113 | | | | | | |
| | 0 | 1 | 1 | 1 | 0 | 0 | 1 | 0 | 114 | | | | | | |
| | 0 | 1 | 1 | 1 | 0 | 0 | 1 | 1 | 115 | | | | | | |
| | 0 | 1 | 1 | 1 | 0 | 1 | 0 | 0 | 116 | | | | | | |
| | 0 | 1 | 1 | 1 | 0 | 1 | 0 | 1 | 117 | | | | | | |
| | 0 | 1 | 1 | 1 | 0 | 1 | 1 | 0 | 118 | | | | | | |
| | 0 | 1 | 1 | 1 | 0 | 1 | 1 | 1 | 119 | | | | | | 0 |
| +1.7 | 0 | 1 | 1 | 1 | 1 | 0 | 0 | 0 | 120 | X | | | | | .572 |
| | 0 | 1 | 1 | 1 | 1 | 0 | 0 | 1 | 121 | X | | | X | | .665 |
| | 0 | 1 | 1 | 1 | 1 | 0 | 1 | 0 | 122 | X | | X | | | .745 |
| | 0 | 1 | 1 | 1 | 1 | 0 | 1 | 1 | 123 | X | | X | X | | .814 |
| | 0 | 1 | 1 | 1 | 1 | 1 | 0 | 0 | 124 | X | X | | | | .872 |
| | 0 | 1 | 1 | 1 | 1 | 1 | 0 | 1 | 125 | X | X | | X | | .926 |
| | 0 | 1 | 1 | 1 | 1 | 1 | 1 | 0 | 126 | X | X | X | | | .975 |
| | 0 | 1 | 1 | 1 | 1 | 1 | 1 | 1 | 127 | X | X | X | X | | 1.018 |
| SP | 1 | 0 | 0 | 0 | 0 | 0 | 0 | 0 | 128 | X | X | X | X | | 1.018 |
| | 1 | 0 | 0 | 0 | 0 | 0 | 0 | 1 | 129 | X | X | X | X | | 1.018 |
| | 1 | 0 | 0 | 0 | 0 | 0 | 1 | 0 | 130 | X | | X | | | .745 |
| | 1 | 0 | 0 | 0 | 0 | 0 | 1 | 1 | 131 | X | | X | | | .745 |
| | 1 | 0 | 0 | 0 | 0 | 1 | 0 | 0 | 132 | X | | | | | .572 |
| | 1 | 0 | 0 | 0 | 0 | 1 | 0 | 1 | 133 | X | | | | | .572 |
| | 1 | 0 | 0 | 0 | 0 | 1 | 1 | 0 | 134 | X | | | | | .572 |
| | 1 | 0 | 0 | 0 | 0 | 1 | 1 | 1 | 135 | X | | | | | .572 |
| -1.7 | 1 | 0 | 0 | 0 | 1 | 0 | 0 | 0 | 136 | | | | | | 0 |
| | 1 | 1 | 1 | 1 | 1 | 1 | 1 | 1 | 256 | | | | | | |

↑ RISING TEMPERATURE

113

FIG. 8

ELECTRIC OPERATION–RETURN AIR CONTROL

FALLING TEMPERATURE ↓

| | DIGITAL SIGNAL (MSB) A | B | C | D | E | F | G | H (LSB) | WORD # | ACTIVE RESISTORS RW1 | RW2 | R1 | R2 | R3 | VALVE CURRENT |
|---|---|---|---|---|---|---|---|---|---|---|---|---|---|---|---|
| | 0 | 0 | 0 | 0 | 0 | 0 | 0 | 0 | 1 | | | | | | 0 |
| | | | | | | | | | | | | | | | |
| | 0 | 1 | 1 | 0 | 1 | 1 | 1 | 1 | 111 | | | | | | 0 |
| +3.4 | 0 | 1 | 1 | 1 | 0 | 0 | 0 | 0 | 112 | X | | | | | .572 |
| | 0 | 1 | 1 | 1 | 0 | 0 | 0 | 1 | 113 | X | | | | X | .636 |
| | 0 | 1 | 1 | 1 | 0 | 0 | 1 | 0 | 114 | X | | | X | | .665 |
| | 0 | 1 | 1 | 1 | 0 | 0 | 1 | 1 | 115 | X | | | X | X | .719 |
| | 0 | 1 | 1 | 1 | 0 | 1 | 0 | 0 | 116 | X | | X | | | .745 |
| | 0 | 1 | 1 | 1 | 0 | 1 | 0 | 1 | 117 | X | | X | | X | .793 |
| | 0 | 1 | 1 | 1 | 0 | 1 | 1 | 0 | 118 | X | | X | X | | .814 |
| | 0 | 1 | 1 | 1 | 0 | 1 | 1 | 1 | 119 | X | | X | X | X | .856 |
| | 0 | 1 | 1 | 1 | 1 | 0 | 0 | 0 | 120 | X | X | | | | .872 |
| | 0 | 1 | 1 | 1 | 1 | 0 | 0 | 1 | 121 | X | X | | | X | .909 |
| | 0 | 1 | 1 | 1 | 1 | 0 | 1 | 0 | 122 | X | X | | X | | .926 |
| | 0 | 1 | 1 | 1 | 1 | 0 | 1 | 1 | 123 | X | X | | X | X | .959 |
| | 0 | 1 | 1 | 1 | 1 | 1 | 0 | 0 | 124 | X | X | X | | | .975 |
| | 0 | 1 | 1 | 1 | 1 | 1 | 0 | 1 | 125 | X | X | X | | X | 1.005 |
| | 0 | 1 | 1 | 1 | 1 | 1 | 1 | 0 | 126 | X | X | X | X | | 1.018 |
| | 0 | 1 | 1 | 1 | 1 | 1 | 1 | 1 | 127 | X | X | X | X | X | 1.045 |
| SP | 1 | 0 | 0 | 0 | 0 | 0 | 0 | 0 | 128 | | | | | | 0 |
| | 1 | 0 | 0 | 0 | 0 | 0 | 0 | 1 | 129 | | | | | | 0 |
| | 1 | 0 | 0 | 0 | 0 | 0 | 1 | 0 | 130 | | | | | | 0 |
| | 1 | 0 | 0 | 0 | 0 | 0 | 1 | 1 | 131 | | | | | | 0 |
| | 1 | 0 | 0 | 0 | 0 | 1 | 0 | 0 | 132 | | | | | | 0 |
| | 1 | 0 | 0 | 0 | 0 | 1 | 0 | 1 | 133 | | | | | | 0 |
| | 1 | 0 | 0 | 0 | 0 | 1 | 1 | 0 | 134 | | | | | | 0 |
| | 1 | 0 | 0 | 0 | 0 | 1 | 1 | 1 | 135 | | | | | | 0 |
| | 1 | 0 | 0 | 0 | 1 | 0 | 0 | 0 | 136 | | | | | | 0 |
| | | | | | | | | | | | | | | | |
| | 1 | 1 | 1 | 1 | 1 | 1 | 1 | 1 | 256 | | | | | | 0 |

↑ RISING TEMPERATURE

115

FIG. 9

ELECTRICAL OPERATION–DISCHARGE AIR CONTROL

FALLING TEMPERATURE ↓

| | DIGITAL SIGNAL (MSB) A | B | C | D | E | F | G | H (LSB) | WORD # | ACTIVE RESISTORS RW1 | RW2 | R1 | R2 | R3 | VALVE CURRENT |
|---|---|---|---|---|---|---|---|---|---|---|---|---|---|---|---|
| | 0 | 0 | 0 | 0 | 0 | 0 | 0 | 0 | 1 | | | | | | 0 |
| | 0 | 1 | 1 | 0 | 1 | 1 | 1 | 1 | 111 | | | | | | 0 |
| | 0 | 1 | 1 | 1 | 0 | 0 | 0 | 0 | 112 | | | | | | 0 |
| | 0 | 1 | 1 | 1 | 0 | 0 | 0 | 1 | 113 | | | | | | 0 |
| | 0 | 1 | 1 | 1 | 0 | 0 | 1 | 0 | 114 | | | | | | 0 |
| | 0 | 1 | 1 | 1 | 0 | 0 | 1 | 1 | 115 | | | | | | 0 |
| | 0 | 1 | 1 | 1 | 0 | 1 | 0 | 0 | 116 | | | | | | 0 |
| | 0 | 1 | 1 | 1 | 0 | 1 | 0 | 1 | 117 | | | | | | 0 |
| | 0 | 1 | 1 | 1 | 0 | 1 | 1 | 0 | 118 | | | | | | 0 |
| | 0 | 1 | 1 | 1 | 0 | 1 | 1 | 1 | 119 | | | | | | 0 |
| +1.7 | 0 | 1 | 1 | 1 | 1 | 0 | 0 | 0 | 120 | X | | | | | .572 |
| | 0 | 1 | 1 | 1 | 1 | 0 | 0 | 1 | 121 | X | | | X | | .665 |
| | 0 | 1 | 1 | 1 | 1 | 0 | 1 | 0 | 122 | X | | X | | | .745 |
| | 0 | 1 | 1 | 1 | 1 | 0 | 1 | 1 | 123 | X | | X | X | | .814 |
| | 0 | 1 | 1 | 1 | 1 | 1 | 0 | 0 | 124 | X | X | | | | .872 |
| | 0 | 1 | 1 | 1 | 1 | 1 | 0 | 1 | 125 | X | X | | X | | .926 |
| | 0 | 1 | 1 | 1 | 1 | 1 | 1 | 0 | 126 | X | X | X | | | .975 |
| | 0 | 1 | 1 | 1 | 1 | 1 | 1 | 1 | 127 | X | X | X | X | | 1.018 |
| SP | 1 | 0 | 0 | 0 | 0 | 0 | 0 | 0 | 128 | | | | | | 0 |
| | 1 | 0 | 0 | 0 | 0 | 0 | 0 | 1 | 129 | | | | | | 0 |
| | 1 | 0 | 0 | 0 | 0 | 0 | 1 | 0 | 130 | | | | | | 0 |
| | 1 | 0 | 0 | 0 | 0 | 0 | 1 | 1 | 131 | | | | | | 0 |
| | 1 | 0 | 0 | 0 | 0 | 1 | 0 | 0 | 132 | | | | | | 0 |
| | 1 | 0 | 0 | 0 | 0 | 1 | 0 | 1 | 133 | | | | | | 0 |
| | 1 | 0 | 0 | 0 | 0 | 1 | 1 | 0 | 134 | | | | | | 0 |
| | 1 | 0 | 0 | 0 | 0 | 1 | 1 | 1 | 135 | | | | | | 0 |
| | 1 | 0 | 0 | 0 | 1 | 0 | 0 | 0 | 136 | | | | | | 0 |
| | 1 | 1 | 1 | 1 | 1 | 1 | 1 | 1 | 256 | | | | | | 0 |

↑ RISING TEMPERATURE

117

FIG. 10

TRANSPORT REFRIGERATION INCLUDING METHODS AND APPARATUS FOR OPTMIZING SAME

TECHNICAL FIELD

The invention relates in general to refrigeration systems, and more specifically to a transport refrigeration system selectively operable with either an electric motor or an internal combustion engine.

BACKGROUND ART

It is common in the field of transport refrigeration to provide both an electric motor and an internal combustion engine, such as a Diesel engine, for selectively driving a refrigerant compressor. The electric motor is manually selected when the system is located at a terminal or other source of electrical potential, and the engine is automatically selected when an electric source is disconnected. The engine has more capacity than an electric motor, but the system must be adjusted so the electric motor will not be overloaded, and thus the extra capacity of the engine is not made available.

Transport refrigeration systems control the temperature of a load space to a selected set point temperature. The temperature of the load space is sensed by a sensor disposed either in the return air path, or in the discharge air path. As disclosed in U.S. Pat. No. 3,973,618, which is assigned to the same assignee as the present application, both a return air and discharge air sensor may be provided, with the discharge air sensor being selected when the set point selection indicates a non-frozen load, and with the return air sensor being selected when the set point selection indicates a frozen load.

Some uses of transport refrigeration systems have a preference for return air control, and some have a preference for discharge air control, regardless of the type of load being conditioned. When both a return air sensor and discharge air sensor are provided on a system where the user may select either one for any type load, the control algorithm must necessarily be set for return air control, to prevent freezing of a non-frozen or perishable load.

It would be desirable and it is the object of the present invention to optimize the performance of a transport refrigeration system of the type which is selectively operable with either an electric motor or an internal combustion engine, and which also has both discharge and return air sensors which may be selected by an operator according to preference

SUMMARY OF THE INVENTION

Briefly, the present invention is a new and improved transport refrigeration system, and method of operation same, which has a refrigerant compressor selectively operable by either an electric motor or an internal combustion engine. The transport refrigeration system is further of the type which is capable of modulating the amount of refrigerant which is returned to the compressor, conditioning the air of a load space to a predetermined set point temperature via heating and cooling modes in response to a selected one of either a return air sensor or a discharge air sensor.

The control of the transport refrigeration system is automatically optimized according to the manual selections of the operative prime move and operative sensor:

(1) taking advantage of the greater capacity of the internal combustion engine to improve temperature pull down time, as well as to accommodate the severe temperature swings which may be encountered when the transport refrigeration system is on the road, ie., away from a terminal where severe ambients are likely to be encountered; and (2) taking advantage of a faster temperature pull down time which may be achieved when using discharge air control.

First, second, third and fourth control algorithms are provided, one of which is automatically selected when an operator manually selects which prime mover is to be operative, and which sensor is to provide a temperature feed-back signal to the refrigeration control. The first algorithm is selected when the internal combustion engine is the prime mover and the return air sensor is selected. The second algorithm is selected when the internal combustion engine and the discharge air sensor are operative. In like manner, the third algorithm is selected when the electric motor and the return air sensor are operative, and the fourth algorithm is selected when the electric motor and discharge sensors are operative.

BRIEF DESCRIPTION OF THE DRAWINGS

The invention will become more apparent by reading the following detailed description in conjunction with the drawings, which are shown by way of example only, wherein:

FIG. 7 is a diagram which sets forth a digital algorithm for implementing the first control algorithm shown graphically in FIG. 2;

FIG. 8 is a diagram which sets forth a digital algorithm for implementing the second control algorithm shown graphically in FIG. 3;

FIG. 9 is a diagram which sets forth a digital algorithm for implementing the third control algorithm shown graphically in FIG. 4; and FIG. 10 is a diagram which sets forth a digital algorithm for implementing the fourth control algorithm shown graphically in FIG. 5.

DESCRIPTION OF PREFERRED EMBODIMENTS

In the following description, certain of the refrigeration control utilized may be conventional, and is shown in U.S. Pat. Nos. 4,712,383; 4,419,866; and 4,325,224, for example. A transport refrigeration system with modulation control of the suction line is shown in co-pending application Ser. No. 304,686, filed February 1, 1989. Digital thermostats which may be used are shown in U.S. Pat. No. 4,819,441 and in co-pending application Ser. No. 236,878, filed Aug. 26, 1988. These patents and patent applications, which are all assigned to the same assignee as the present application, are hereby incorporated into the specification of the present application by reference.

Figure 1:
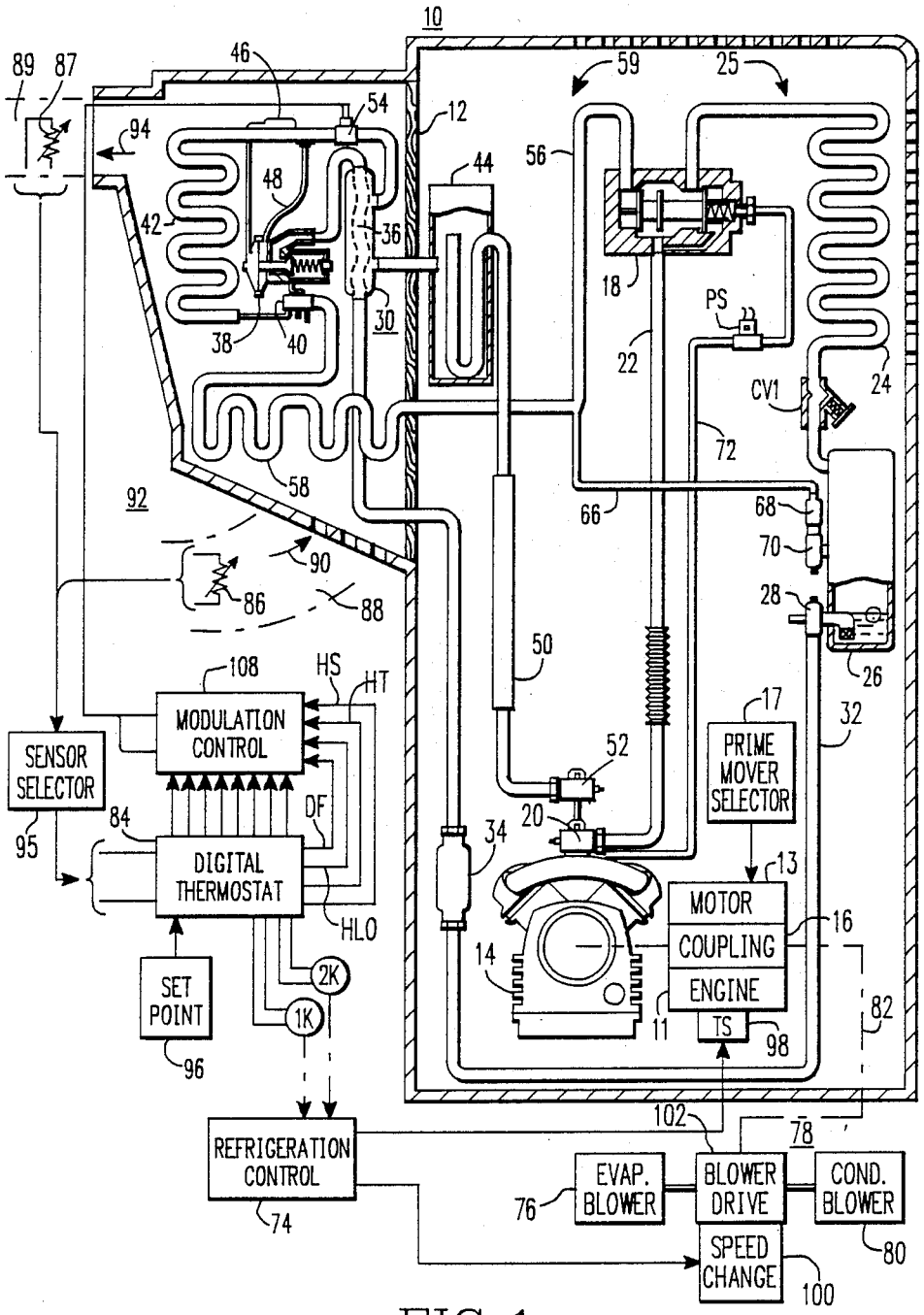
FIG. 1 is a piping and control diagram of a transport refrigeration constructed according to the teachings of the invention.

Referring now to the drawing, and to FIG. 1 in particular, there is shown a transport refrigeration system 10 constructed according to the teachings of the invention. Refrigeration system 10 is mounted on the front wall 12 of a truck, trailer, container, or the like. Refrigeration system 10 includes a closed fluid refrigerant circuit which includes a refrigerant compressor 14 driven by a selectable one of two prime movers, including an internal combustion engine 11, eg., a Diesel engine, an electric motor 13, and a suitable coupling 16. A prime mover selector 17 has an "electric run"position and a "Diesel"position. When the electric motor 13 is selected by selector 17, the Diesel engine 11 is automatically disengaged. When the electric motor 13 is disconnected, the Diesel engine 11 is automatically operative to drive compressor 14.

Discharge ports of compressor 14 are connected to an inlet port of a three-way valve 18 via a discharge service valve 20 and a hot gas conduit or line 22. The functions of the three-way valve 18, which has heating and cooling positions, may be provided by separate valves, if desired.

One of the output ports of three-way valve 18 is connected to the inlet side of a condenser coil 24. This port is used as a"cooling"position of three-way valve 18, and it connects compressor 14 in a first refrigerant circuit 25. The outlet side of condenser coil 24 is connected to the inlet side of a receiver tank 26 via a one-way condenser check valve CV1 which enables fluid flow only from the outlet side of condenser coil 24 to the inlet side of receiver tank 26. An outlet valve 28 on the outlet side of receiver tank 26 is connected to a heat exchanger 30 via a liquid conduit or line 32 which includes a dehydrator 34.

Liquid refrigerant from liquid line 32 continues through a coil 36 in heat exchanger 30 to an expansion valve 38. The outlet of expansion valve 38 is connected to a distributor 40 which distributes refrigerant to inlets on the inlet side of an evaporator coil 42. The outlet side of evaporator coil 42 is connected to the inlet side of a closed accumulator tank 44 via a controllable suction line modulation valve 54 and heat exchanger 30. Expansion valve 38 is controlled by an expansion valve thermal bulb 46 and an equalizer line 48. Gaseous refrigerant in accumulator tank 44 is directed from the outlet side thereof to the suction port of compressor 14 via a suction line 50, a suction line service valve 52, and the controllable suction line modulation valve 54. The modulation valve 54 is preferably located in the illustrated portion of suction line 50 adjacent to the outlet of evaporator 42 and prior to heat exchanger 30 and accumulator 44, in order to protect compressor 14 by utilizing the volumes of these devices to accommodate any liquid refrigerant surges which may occur while modulation valve 54 is being controlled.

The operative prime mover may be protected against overload by controlling the modulation valve 54 to provide the function of a conventional compressor throttling valve, as taught in my co-pending application Ser. No. 458,206, filed 12-28-89 or, a conventional compressor throttling valve may be disposed in the suction line 50, as desired.

The remaining output port of three-way valve 18 is connected to the inlet side of a defrost pan heater 58 via a hot gas line 56. This position of three-way valve 18 is the"heating"position, connecting compressor 14 in a second refrigerant circuit 59. In the heating position of three-way valve 18, the hot gas line 56 extends from the three-way valve 18 to the inlet side of the evaporator coil 42 via the defrost pan heater 58 which is located below the evaporator coil 42. A by-pass conduit or pressurizing tap 66, extends from hot gas line 56 to receiver tank 26 via by-pass and service check valves 68 and 70, respectively.

A conduit 72 connects three-way valve 18 to the low pressure side of compressor 14 via a normally closed pilot solenoid valve PS. When solenoid operated valve PS is closed, three-way valve 18 is spring biased to the cooling position, to direct hot, high pressure gas from compressor 14 to condenser coil 24. Condenser coil 24 removes heat from the gas and condenses the gas to a lower pressure liquid. When evaporator 42 requires defrosting, and also when a heating mode is required to hold the thermostat set point of the load being conditioned, pilot solenoid valve PS is opened via voltage provided by a refrigeration control function 74. Three-way valve 18 is then operated via the resulting drop in pressure to its heating position, in which flow of refrigerant in the form of hot gas to condenser 24 is sealed and flow to evaporator 42 is enabled. Suitable control 74 for operating solenoid valve PS is shown in the incorporated patents.

The heating position of three-way valve 18 thus diverts the hot high pressure discharge gas from compressor 14 from the first or cooling mode refrigerant circuit 25 into the second or heating mode refrigerant circuit 59 which includes distributor 40, defrost pan heater 58, and the evaporator coil 42. Expansion valve 38 is bypassed during the heating mode. If the heating mode is a defrost cycle, an evaporator fan or blower 76 is not operated. During a heating cycle required to hold a thermostat set point temperature, the evaporator blower 76 is operated. Evaporator blower 76 is part of air delivery means 78, which also includes a condenser fan or blower 80. Air delivery means 78 may be belt driven from the operative prime mover and coupling 16, for example, as indicated by broken line 82.

Refrigeration control 74 includes a digital thermostat 84 having first and second selectable temperature sensors 86 and 87. The first sensor 86 is disposed in a return air path 88 in which return air, indicated by arrow 90, is drawn from a served load space 92 through return air path 88. The second sensor 87 is disposed in a discharge air path 89, in which discharge air, indicated by arrow 94, is discharged by evaporator blower 76 into the served space 92. A manual sensor selector 95 selects which sensor, the return air sensor 86 or the discharge air sensor 87, is to provide the temperature feed back signal for the digital thermostat 84. Thus, return air 90 is then conditioned by drawing it through evaporator 42, and conditioned air 94 is discharged back into the served space 92 by evaporator blower 76. The digital thermostat 84 includes set point selector means 96 for selecting the desired set point temperature to which system 10 will control the temperature of the served space 92.

Signals provided by digital thermostat 84 control heat and speed relays 1K and 2K, respectively, which have contacts in refrigeration control 74, as illustrated in the incorporated patents. Heat relay 1K is de-energized when system 10 should be in a cooling mode, and it is energized when system 10 should be in a heating mode. When the Diesel engine 11 is the operative prime mover, speed relay 2K is de-energized when the engine should be operating at low speed, eg., 1400 RPM, and it is energized when the engine should be operating at high speed, eg., 2200 RPM. When the electric motor 13 is the operative prime mover, it operates at a single speed.

According to the teachings of the invention, first, second, third and fourth different control algorithms 111, 113, 115, 117 are utilized, with one of the four being selected according to the selections made by the prime mover selector 17 and the sensor selector 94. The four different control algorithms 111, 113, 115, and l17 are respectively set forth in charts or diagrams in FIGS. 2, 3, 4 and 5, and in digital form in FIGS. 7, 8, 9 and 10. Operation with a falling temperature in the load space 92 is indicated along the left hand side of each diagram, starting at the top, and operation with a rising temperature in the load space 92 is indicated along the right hand side, starting at the bottom. Contacts of the heat relay 1K, for example, are connected in refrigeration control 74 to de-energize and energize the pilot solenoid valve PS, to select cooling and heating modes, respectively. Contacts of the speed relay 2K, for example, are connected in refrigeration control 74 to deenergize and energize a throttle solenoid (TS) 98 associated with the internal combustion engine 11, for selecting low and high speeds, respectively, when the engine 11 is the prime mover. When the Diesel engine 11 is the operative prime mover, contacts of speed relay 2K may also be connected to provide a signal for a speed change unit 100 associated with a blower drive arrangement 102 of the air delivery means 78. Blower drive arrangement 102 and speed change unit 100 are arranged to provide a substantially constant volume of conditioned air 94 for served space 92, regardless of the speed of the engine.

Figure 2:
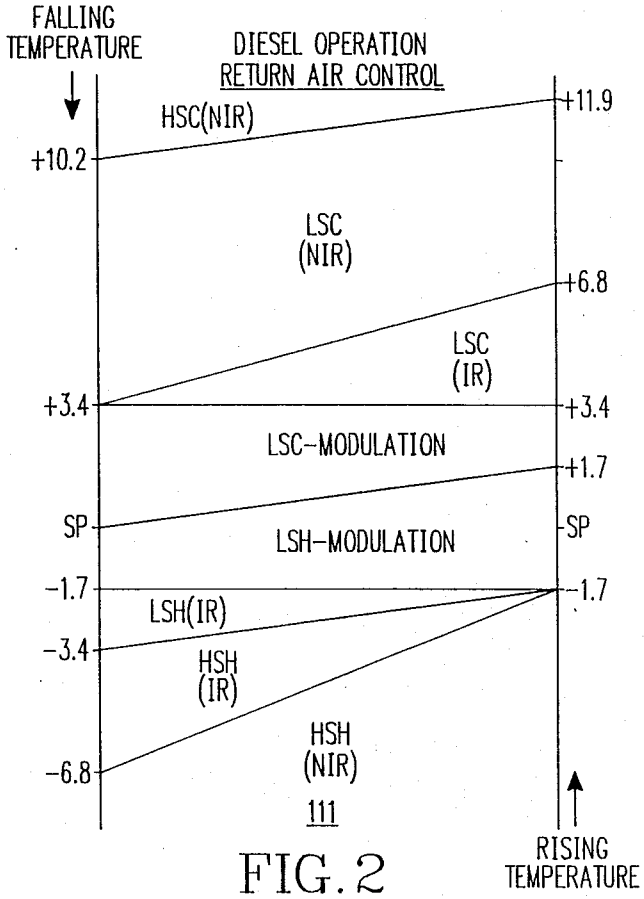
FIG. 2 is a diagram setting forth a first control algorithm which is automatically selected when a Diesel engine is driving the refrigerant compressor shown in FIG. 1, and a return air sensor is providing feedback to refrigerant control.
Figure 3:
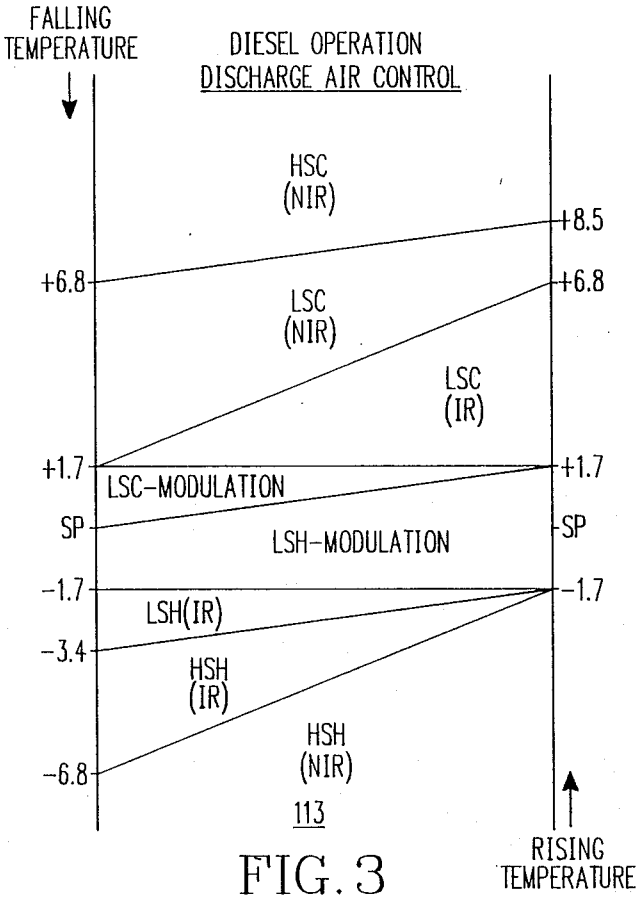
FIG. 3 is a diagram setting forth a second control algorithm which is automatically selected when the Diesel engine and a discharge air sensor are operative.

FIGS. 2 and 3 set forth control algorithms 111 and 113 used when compressor 14 is driven by Diesel engine 11. The control algorithm 111 of FIG. 2 is used when the temperature feedback signal is being provided by the return air sensor 86, and the control algorithm 113 of FIG. 3 is used when the discharge air sensor 87 is operative. With a falling temperature, ie., during temperature pull down, system 10 will be in a cooling mode and it will operate engine 11 at high speed. This mode is called high speed cool, not in range, abbreviated HSC (NIR). When the temperature of the return air reaches a predetermined value relative to the selected set point temperature SP, the engine speed is dropped to low speed, and this mode is called low speed cool, not in range, or LSC (NIR). It will be noted that with discharge air control the system may be maintained in high speed longer than with return air control, reducing pull down time. This is due to the fact that with return air control the system is responding to the warmest air in the served space 92, and care must be taken not to freeze the load in the vicinity of the discharge air. Thus, low speed is initiated at a higher value relative to set point when on return air control, such as at +10.2 instead of +6.8, as illustrated in the charts. The values listed are exemplary, and may indicate either temperature difference, or control error, as desired.

At predetermined points relative to set point SP, which is manually selected by set point selector 96, the mode changes from LSC (NIR) to low speed cool, in range, with modulation of the refrigerant returning to compressor 14 via suction line 50 by controlling modulation valve 54. For the same reason that high speed may be prolonged when on discharge air control, low speed cool without modulation may be prolonged when on discharge air control, with modulation beginning at +1.7 above set point SP when on discharge air control and at +3.4 above set point SP when on return air control.

When the temperature being sensed drops below set point SP, the algorithms 111 and 113 are the same for either sensor. Low speed heat with suction line modulation occurs until the difference reaches −1.7, at which point the mode changes to low speed heat, in range. If the difference reaches −3.4 the mode changes to high speed heat, in range, and if it reaches −6.8 the mode changes to high speed heat, not in range.

When the sensed temperature is rising, the right hand sides of the charts indicate the control algorithm process. Below set point SP both algorithms are similar, changing from high speed heat, not in range, to low speed heat with modulation at −1.7. At +1.7 low speed cool with modulation is required when on return air control, while the algorithm goes directly to low speed cool, in range, without modulation, when on discharge air control. Low speed cool, in range is entered at +3.4 when on return air control.

Figure 5:
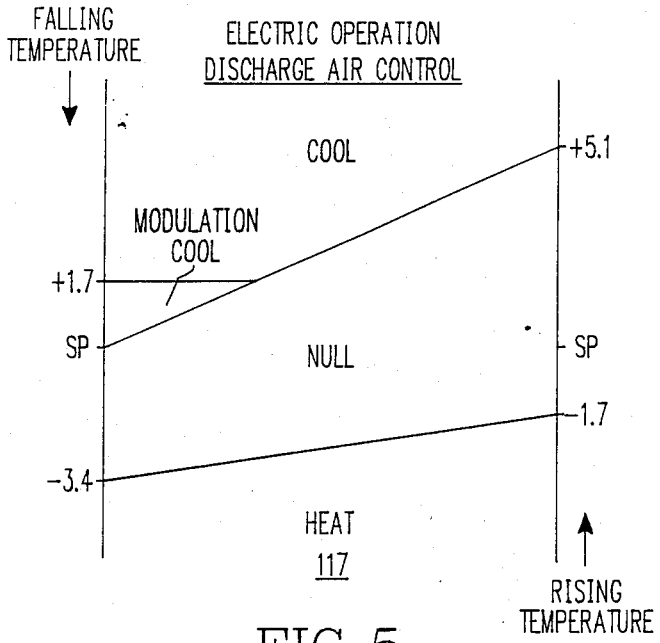
FIG. 5 is a diagram setting forth a fourth control algorithm which is automatically selected when the electric motor and discharge air sensor are operative.
Figure 4:
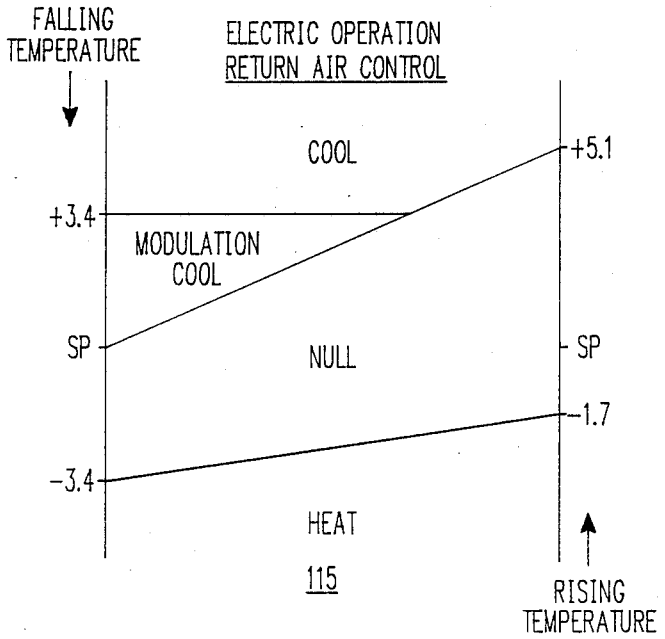
FIG. 4 is a diagram setting forth a third control algorithm which is automatically selected when the electric motor shown in FIG. 1 is driving the refrigerant compressor and the return air sensor is operative.

FIGS. 4 and 5 are control algorithms 115 and 117 used when electric motor 13 is driving compressor 14, with FIG. 4 indicating algorithm 115 for return air control and with FIG. 5 indicating algorithm 117 for discharge air control. Different algorithms are used for electric operation in order to provide maximum capacity when on Diesel, without overloading the electric motor 13 when on electric drive. Also, when suction line modulation is used, it is unlikely that the unit will switch to a heating mode. With suction line modulation, a heating mode would only be required at very low ambients. When on electric drive, system 10 will be associated with a transport unit which will be stopped, inside or close to a terminal, where low ambients are not as likely to occur. Thus, with electric, once set point is reached the control algorithm simply shuts the electric motor 13 off, with the system 10 then being in null until the temperature rises above set point, or until it drops to predetermined value, such as −3.4 relative to set point, at which time system 10 switches to the hot gas heating mode. At this point, the modulation range has been passed and system 10 switches from null to heat without modulation.

More specifically, with electric drive the system 10 operates in a cooling mode until reaching a predetermined point relative to set point SP, with the predetermined point being closer to set point with discharge air control than with return air control, for the reasons hereinbefore pointed out relative to engine operation. Thus, pull down time when on discharge air control will be faster than when on return air control. As indicated, cooling with suction line modulation is initiated at +1.7 with discharge air control, and at +3.4 with return air control. After both algorithms 115 and 117 enter the null mode they operate the same. If the temperature rises while the null mode is in effect, electric motor 13 will be re-energized at +5.1, well past the modulation range, so the cool mode is entered. If the temperature drops while the null mode is in effect, a heat mode is entered at −3.4.

Figure 6:
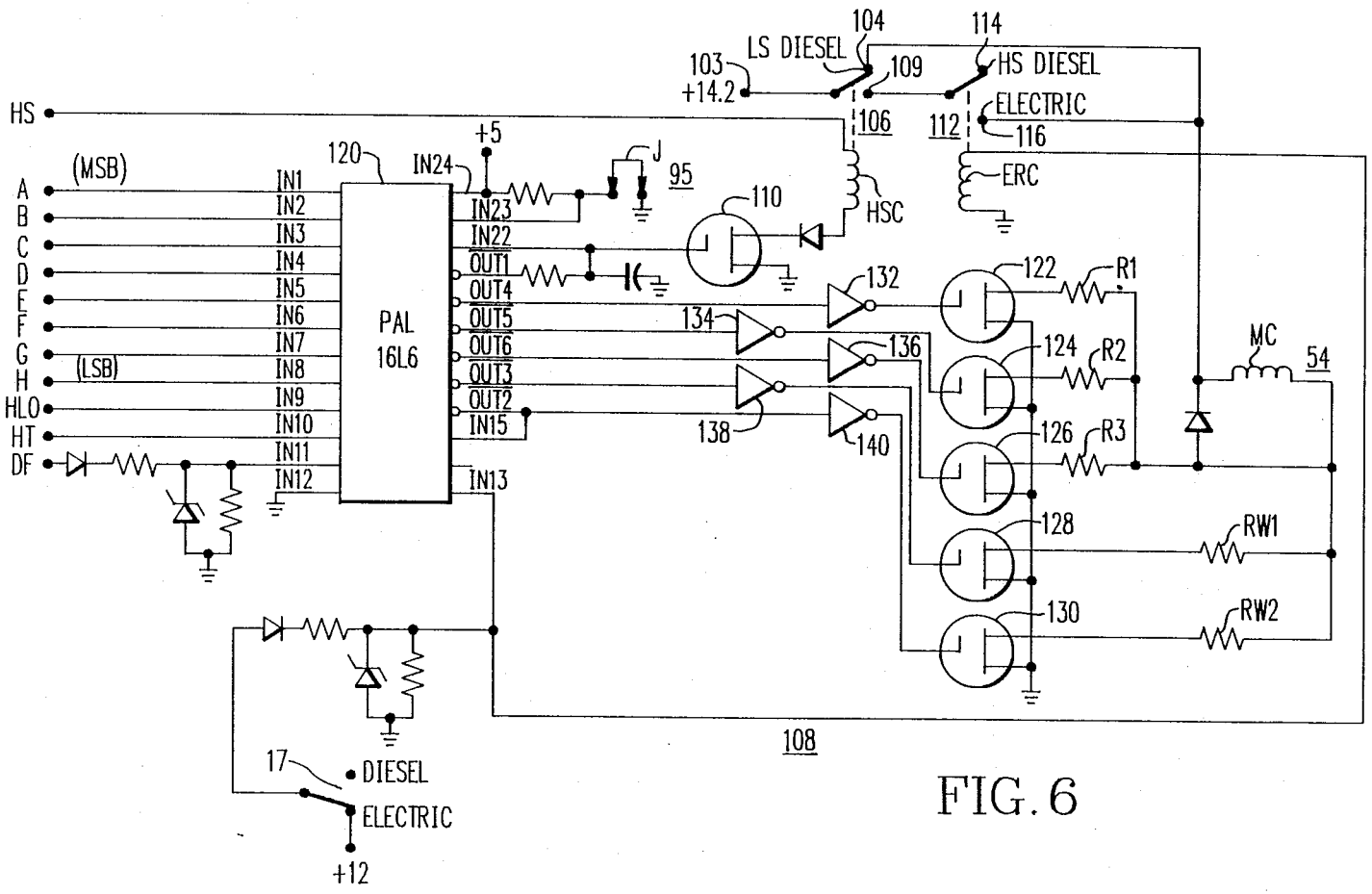
FIG. 6 is a detailed schematic diagram of modulation control which may be used for the modulation function shown in block form in FIG. 1.

Modulation valve 54 includes a control coil MC shown in FIG. 6. FIG. 6 is a schematic diagram illustrating a preferred implementation of modulation control 108 shown in block form in FIG. 1. With no current flowing in coil MC, valve 54 is open. Increasing the coil current from zero provides a predetermined valve closing characteristic, fully closing valve 54 at a predetermined current. Decreasing the coil current opens valve 54, following a predetermined opening characteristic.

Digital thermostat 84 provides an 8 -bit digital signal having a magnitude responsive to the difference between the temperature sensed by the selected sensor, and the set point temperature selected by set point selector 96. This digital signal from thermostat 84 is translated to the desired valve control current by modulation control As shown in FIG. 6, coil MC of modulation valve 52 is connected to a source 103 of unidirectional potential via a normally closed contact 104 of a high speed relay 106. Coil HSC of high speed relay 106, which also has a normally open contact 109, is connected to be energized by a true high speed signal HS provided by thermostat 84, and by a solid state switch 110, such as by International Rectifier's IRFDl20. Contact 109 of high speed relay 106 is connected to energize an electric run relay 112 when high speed relay coil HSC is energized. Electric run relay 112 includes an electromagnetic control coil ERC, a normally closed contact 114, and a normally open contact 116. Thus, modulation coil MC may be energized when on low speed Diesel operation, when coil HSC of high speed relay is de-energized. Modulation coil MC may also be energized when coil HSC of high speed relay is energized, when the electric run relay coil ERC is simultaneously energized.

An 8-bit digital signal A-H from thermostat 84, with A being the MSB and H being the LSB, is applied to a programmable logic array 120, such as a PAL l6L6. This digital signal, which indicates the difference between the load temperature and the selected set point temperature SP, along with a heat lock out signal HLO and a heat signal HT, also provided by thermostat 84, a defrost signal DF provided by suitable defrost control, an electric run signal provided by selector switch 17, and a signal responsive to which sensor has been selected, are all decoded by logic array 120 to control the current flow through coil MC of the modulation valve 54.

The sensor selector 95, shown in block form in FIG. 1, is indicated in FIG. 6 by a jumper J. When jumper J is in the position indicated, it indicates that the return air sensor is controlling. When jumper J is removed it indicates that the discharge air sensor is controlling. The jumper J may simply be a switch contact of sensor selector 95, making the input signal applied to input IN23 automatically dependent upon the position of selector switch 95. Input IN23 is high, or a logic one when the discharge air sensor 87 is controlling and low or a logic zero when the return air sensor 86 is controlling.

Prime mover selector switch 17 is connected to input INl3, with the input being a logic one when electric drive is selected and a logic zero when the Diesel engine is selected.

Output /OUT1 controls the hereinbefore mentioned solid state switch 110. In like manner, outputs /OUT2, /OUT3, /OUT4, /OUT5 and /OUT6 respectively control solid state switches 122, 124, 126, 128 and 130 via inverter gates 132, 134, 136, 138 and 140. When one of the outputs goes low the associated inverter gate provides a logic one, turning on the associated solid state switch. The solid state switches, when active, control a plurality of parallel connected resistors, and thus the current flowing through coil MC. Switches 122, 124, 126, 128 and 130, when conductive, respectively select resistors Rl, R2, R3, RW1 and RW2.

The Boolean equations for the outputs of logic array 120 are as follows:

```
/OUT1 =  /IN1*IN2*/1N3*IN4*/IN9*/IN10*/IN11*/IN13*/IN23 +
         /IN1*IN2*IN3*/IN9*/IN10*/IN11*/IN13 +
         /IN22*/IN1*IN2*/IN3*/IN4*IN5*/IN9*/IN10*/IN11*
         /IN13*/IN23 +
         /IN22*/IN1*IN2*/IN3*IN4*IN5*/IN9*/IN10*
         /IN11*/IN13
/OUT2 =  /IN1*IN2*IN3*IN4*/IN9*/IN11*/IN23 +
         /IN1*IN2*IN3*IN4*IN5*/IN9*/IN11*IN23 +
         IN1*/IN2*/IN3*/IN4*/IN5*/IN9*/IN11*/IN13
/OUT3 =  /IN1*/IN15*IN5*/IN23 +
         /IN1*/IN15*IN6*IN23 +
         IN1*/IN15*/IN6*/IN13
/OUT4 =  /IN1*/IN15*IN6*/IN23 +
         /IN1*/IN15*IN7*IN23 +
         IN1*/IN15*/IN7*/IN13
/OUT5 =  /IN1*/IN15*IN7*/IN23 +
         /IN1*/IN15*IN8*IN23
/OUT6 =  /IN1*/IN15*IN8*/IN23 +
         IN1*/IN15*/IN8*/IN13
```

The algorithms 111, 113, 115, and 117 shown diagrammatically in FIGS. 2, 3, 4 and 5 are shown in digital form in FIGS. 7, 8, 9 and 10, respectively. The digital algorithms of FIGS. 7, 8 9 and 10 illustrate values of the digital signal A–H near set point SP. The digital algorithm in FIG. 7 is for Diesel operation with return air control, the digital algorithm in FIG. 8 is for Diesel operation with discharge air control, the digital algorithm in FIG. 9 is for electric motor operation with return air control, and the digital algorithm in FIG. 10 is for electric motor operation with discharge air control. The digital algorithms indicate, for each bit change of the digital signal A–H above and below set point SP, which parallel resistors are actively controlling the current through the modulating coil MC, and the value of the current in amperes.

I claim:

1. In a method of operating a transport refrigeration system having a compressor selectively operable with either an electric- motor or an internal combustion engine, and including control for conditioning the air of a load space to a pre-selected set point via heating and cooling modes in response to a selected one of either a return air sensor or a discharge air sensor, the improvement comprising:

providing first, second, third, and fourth control algorithms, selecting one of the first and second control algorithms when the compressor is operated with an internal combustion engine, selecting one of the third and fourth control algorithms when the compressor is operated with an electric motor, selecting one of the first and third control algorithms when the air is conditioned in response to a return air sensor, and selecting one of the second and fourth control algorithms when the air is conditioned in response to a discharge air sensor.

2. In the method of claim 1 wherein the refrigeration system includes a modulation valve which modulates refrigerant flow to the compressor, the step of modulating the refrigerant flow in predetermined temperature ranges relative to set point in each of the first, second, third and fourth control algorithms.

3. In the method of claim 2 including the step of starting the modulation ranges start closer to set point during temperature pull down in the second and fourth control algorithms, during which air is being conditioned in response to a discharge air sensor, than in the first and third control algorithms during which air is being conditioned in response to a return air sensor.

4. In the method of claim 2 including the step of modulating refrigerant flow during a heating mode in only the first and second control algorithms, during which the compressor is being operated by an internal combustion engine.

5. In the method of claim 1 including the step of shutting down the refrigeration system when the sensed temperature drops below set point in only the third and fourth algorithms, during which the compressor is operated by an electric motor.

6. In a transport refrigeration system having a compressor selectively operable with either an electric motor or an internal combustion engine, and including control for conditioning the air of a load space to a preselected set point via heating and cooling modes in response to a selected one of either a return air sensor or a discharge air sensor, the improvement comprising:

first, second, third, and fourth control algorithms, means for selecting one of said first and second control algorithms when the compressor is operated with an internal combustion engine, means for selecting one of said third and fourth control algorithms when the compressor is operated with an electric motor, means for selecting one of the first and third control algorithms when the air is conditioned in response to a return air sensor, and means for selecting one of the second and fourth control algorithms when the air is conditioned in response to a discharge air sensor.

7. In the transport refrigeration system of claim 6 wherein the refrigeration system includes a modulation valve which modulates refrigerant flow to the compressor, and including means for operating the modulation valve to modulate the refrigerant flow in predetermined temperature ranges relative to set point in each of the first, second, third and fourth control algorithms.

8. In the transport refrigeration system of claim 7 wherein the modulation ranges start closer to set point during temperature pull down in the second and fourth control algorithms, during which air is being conditioned in response to a discharge air sensor, than in the first and third control algorithms during which air is being conditioned in response to a return air sensor.

9. In the transport refrigeration system of claim 7 wherein only the first and second control algorithms modulate refrigerant flow during a heating mode, during which the compressor is being operated by an internal combustion engine.

10. In the transport refrigeration system of claim 6 wherein only the third and fourth algorithms shut down the refrigeration system when the sensed temperature drops below set point, during which the compressor is operated by an electric motor.

* * * * *